US006566618B2

(12) United States Patent
Hamada et al.

(10) Patent No.: US 6,566,618 B2
(45) Date of Patent: May 20, 2003

(54) CIRCUIT BREAKER

(75) Inventors: Yoshinobu Hamada, Saitama (JP); Katsunori Kuboyama, Saitama (JP); Tatsunori Takahashi, Saitama (JP); Naoshi Uchida, Saitama (JP)

(73) Assignee: Fuji Electric Co., Ltd., Kawasaki (JP)

( * ) Notice: Subject to any disclaimer, the term of this patent is extended or adjusted under 35 U.S.C. 154(b) by 6 days.

(21) Appl. No.: 09/987,208

(22) Filed: Oct. 25, 2001

(65) Prior Publication Data

US 2002/0063049 A1 May 30, 2002

(30) Foreign Application Priority Data

Oct. 30, 2000 (JP) ..... 2000-329932

(51) Int. Cl.[7] ..... H01H 9/20

(52) U.S. Cl. ..... 200/308; 200/323; 200/324; 200/330; 200/331

(58) Field of Search ..... 200/17 R, 400, 200/401, 500, 501, 564, 572, 308, 318, 323, 324, 327, 329–331, 334, 336

(56) References Cited

U.S. PATENT DOCUMENTS 3,301,972 A * 1/1967 Brumfield ..... 200/17 R
5,288,958 A * 2/1994 Grunert et al. ..... 200/331
5,493,083 A * 2/1996 Olivier ..... 200/17 R
5,902,973 A * 5/1999 Ramey et al. ..... 200/50.01
6,441,329 B2 * 8/2002 Guille et al. ..... 200/400
6,518,526 B2 * 2/2003 Hamada et al. ..... 200/330

* cited by examiner

*Primary Examiner*—Michael Friedhofer
(74) *Attorney, Agent, or Firm*—Kanesaka & Takeuchi

(57) ABSTRACT

In a circuit breaker, a rotary-operating handle is linked with an opening and closing mechanism via a driving gear so that main circuit contacts can be opened and closed by rotating an opening and closing lever. A vertically moving handle lock lever is arranged between a tip of the opening and closing lever and the driving gear directly coupled to the operating handle, so that when the main circuit contacts are opened after being welded, the lock lever abuts against the driving gear to restrain the operating handle to the vicinity of the ON position, thereby restricting the movement to a contact-open indicating position. Further, an upward-inclined surface is formed in a stopper section located at a tip of the lock lever, so that if the contact welding is not severe, the lock lever can be pushed down to forcibly open the contacts.

3 Claims, 4 Drawing Sheets

[OFF]

[ON]

[CONTACT WELDING]

CIRCUIT BREAKER

BACKGROUND OF THE INVENTION AND RELATED ART STATEMENT

The present invention relates to a circuit breaker, such as an autobreaker applied to a control of an electric motor, in particular, to an interlock mechanism for indicating errors that allow an operator to identify an abnormal state of main circuit contacts caused by welding thereof, on the basis of a position of a rotary-operating handle.

The basic structure of the autobreaker in which the present invention is implemented will be described with reference to FIGS. 4(*a*) to 4(*d*). In FIG. 4(*a*), reference numeral 1 denotes a breaker case, numeral 2 denotes a breaking section for main circuit contacts, numeral 3 is an opening and closing mechanism section, numeral 4 is an overcurrent tripping device, numeral 5 is a rotary-operating handle installed on a top surface of the case 1, numeral 6 is a gear mechanism for coupling the rotary-operating handle 5 to the opening and closing mechanism section 3 for transmission, and numeral 7 is an accessory, i.e. auxiliary switch, alarm switch, or the like.

In this case, as shown in FIGS. 4(*b*) and 4(*c*), the opening and closing mechanism section 3 comprises an upper toggle gear 3*a*, an opening and closing lever 3*b* disposed in a lower part of the breaker, a toggle link mechanism 3*c* for linking the toggle gear 3*a* and the opening and closing lever 3*b*, and a latch mechanism 3*d*, with all of these components being assembled to the opening and closing mechanism. The toggle gear 3*a* is coupled to the rotary-operating handle 5 via a driving gear 8 for transmission. Further, the opening and closing lever 3*b* is journaled so as to rotationally move in a vertical direction via a support shaft 3*b*-1. An urge spring, i.e. torsion coil spring 3*b*-2 provided on the shaft impels the lever in a direction to open the main circuit contact. The tip of the lever 3*b* projects to the side through a frame slot portion in the opening and closing mechanism section 3. The driving gear 8 is directly coupled to a shaft of the operating handle 5. The operating handle 5 is impelled and biased by a relatively weak return spring (spiral spring) in a direction such that it returns to the OFF position.

On the other hand, the breaking section 2 for the main circuit contacts is formed of an assembly of a fixed contact shoe 2*a*, a bridge-type movable contact shoe 2*b*, a movable contact shoe holder 2*c*, a contact spring (compression spring) 2*d* for the movable contact shoe 2*b*, and arc-extinguishing plates 2*e*. An upper end of the movable contact holder 2*c* is located opposite to a tip of the opening and closing lever 3*b*. The figure shows an ON state in which the main circuit contacts are closed. In this state, the tip of the opening and closing lever 3*b* is held in a position in which it retreats upward, and the movable contact shoe 2*b* is in contact with the fixed contact shoe 2*a* under the force of the contact spring 2*d*.

With this construction, while the main circuit contacts are closed, the operating handle 5 is held in the ON position so as to indicate that position. Then, when the operating handle 5 is manually rotated from the ON position to the OFF position so as to open the main circuit contact, the toggle link mechanism 3*c* of the opening and closing mechanism section 3 releases the opening and closing lever 3*b* via the driving gear 8 and the toggle gear 3*a*. Thus, the opening and closing lever 3*b* rotationally moves clockwise under the accumulated force of the urge spring 3*b*-2 to strike the movable contact shoe holder 2*c*, thereby opening the movable contact shoe 2*b*.

Further, in contrast, when the operating handle 5 is rotated from the OFF position to the ON position, the link mechanism 3*c* of the opening and closing mechanism section 3 pushes a rear end of the opening and closing lever 3*b* downward against the urge spring 3*b*-2. Thus, the opening and closing lever 3*b* rotationally moves counterclockwise to release the movable contact shoe holder 2*c* from the pressure, so that the movable contact shoe 2*b* moves upward under the force of the contact spring 2*d*, subsequently comes to contact with the fixed contact shoe 2*a*, and is then closed. Simultaneously, the operating handle 5 is held in the ON position to indicate that the main circuit contacts are closed.

On the other hand, if the overcurrent tripping device 4 is activated when the main circuit contacts are closed to conduct electricity through the breaker, the latch mechanism 3*d* of the opening and closing mechanism section 3 is released to activate the toggle link mechanism 3*c*. Then, as in the above-described OFF operation, the opening and closing lever 3*b* rotates clockwise to perform a trip operation, to thereby open the movable contact shoe 2*b*. In this case, the operating handle 5 is stopped at a TRIP position between the ON and OFF positions to indicate that the main circuit contacts are opened due to the trip operation. To activate the main circuit contacts after the trip operation, the operating handle 5 is rotated from the TRIP position to the OFF position to reset a latch receiver of the latch mechanism 3*d*, and is then rotated to the ON position to close the main circuit contact.

In the circuit breaker constructed as described above, if an excess current flows during the conduction, the contacts of the fixed contact shoe 2*a* and movable contact shoe 2*b* of the main circuit contacts may be welded together. If such contact welding occurs and is severe, the movable contact shoe 2*b* does not separate from the fixed contact shoe 2*a*, despite the fact that the overcurrent tripping device 4 of the circuit breaker is activated to cause the opening and closing mechanism section 3 to perform the trip operation. Further, the opening and closing lever 3*b* of the opening and closing mechanism section 3 is restrained by the movable contact shoe holder 2*c* and can not be rotated to the contact open position. Thus, it remains stopped at a position between the ON and TRIP positions, while pressing the movable contact shoe holder 2*c*. On the other hand, the operating handle 5 moves from the ON position to the TRIP position, following the operation of the opening and closing mechanism section 3 despite the contact welding. In this position, the operating handle indicates the trip operation of the circuit breaker.

Accordingly, if a maintenance worker touches the load-side circuit while performing an inspection following the trip operation based on the wrong assumption that the main circuit contacts are opened, on the basis that the operating handle 5 indicates the TRIP position, without noticing the abnormal state of contact welding, an electric shock may occur, due to the fact that the main circuit contacts of the circuit breaker are not actually open.

Thus, as measures for preventing such an accident, there is known a circuit breaker comprising interlock means that restrains the operating handle 5 to be located to a position closer to the ON position than to the TRIP position, so that the handle will not indicate the TRIP position when the contact welding occurs during the trip operation of the circuit breaker. A conventional construction of such a circuit breaker is shown in FIGS. 5(*a*)–5(*d*). That is, as shown in this figure, the opening and closing mechanism section 3 has a metallic handle lock lever 9 incorporated therein and linked therewith so as to move in the vertical direction and follow the rotational movement of the opening and closing lever 3*b*. An upper end of the lever 9 is located at a side opposite to a circular recess groove 5*a* formed in a rear surface of the rotary-operating handle 5. FIG. 5(*a*) is a top view showing ON and OFF positions of the rotary-operating handle 5 and a position indicating the occurrence of contact welding. FIGS. 5(*b*) to 5(*d*) show the operational states of the main circuit contact, the opening and closing mechanism section, and the handle lock lever corresponding to the ON and OFF positions and the trip operation performed when the contact welding occurs, respectively.

In this case, if the main circuit contacts are normal (contact welding does not occur), when the contacts are turned off as shown in FIG. 5(*b*), the lock lever 9 is lowered so as to follow the rotational movement of the opening and closing lever 3*b*, so that the tip thereof slips out of the recess groove 5*a* in the operating handle 5. On the other hand, if the overcurrent tripping device performs the trip operation to open the main circuit contact, the lock lever 9 also is lowered so as to follow the movement of the opening and closing lever 3*b*, as described above. Consequently, the operating handle 5 is not restrained by the lock lever 9 but can be manually returned from the TRIP to the OFF position for resetting. Further, when the operating handle 5 is placed in the ON position, the lever 9 elevates so as to follow the movement of the opening and closing lever 3*b*, so that the tip thereof is fitted into the recess groove 5*a* in the operating handle, as shown in FIG. 5(*c*). When, however, the operating handle 5 is rotated from the ON position to the OFF position, the lock lever 9 is lowered during the rotation so as to follow the movement of the opening and closing lever 3*b*, and then slips out of the recess groove 5*a*. Consequently, the handle operation is not hampered.

On the other hand, if the contact welding occurs during the trip operation of the circuit breaker, the opening and closing lever 3*b* is restrained by the movable contact shoe holder 2*c* and prevented from rotating to the open position, as shown in FIG. 5(*d*). Accordingly, the lock lever 9 is not lowered but remains fitted into the recess groove 5*a* in the operating handle 5. Thus, the operating handle 5 is engaged and locked by the lock lever 9 after rotating through only a small angle from the ON position, and it does not indicate the TRIP position. This allows the operator to identify the contact welding induced by the abnormal state.

There are problems with the structure and functions of the conventional mechanism shown in FIGS. 5(*a*)–5(*d*), which is installed in the circuit breaker as means for identifying the contact welding induced abnormal state, as described below.

(1) When the handle lock lever 9 is incorporated in the opening and closing mechanism section 3, it is necessary to prevent the lever from interfering with a toggle gear, a toggle link mechanism, and others that are assembled in the same opening and closing mechanism section, resulting in space restrictions. Further, the opening and closing mechanism section 3 has a complex structure, thereby requiring a time for assembly.

(2) If the contact welding occurs in the main circuit contact, even if it is not severe, a time-consuming recovery operation must be performed, in which the circuit breaker is disassembled to remove the contact-breaking section, and the fixed contact shoe 2*a* and the movable contact shoe 2*b*, which are welded together, are separated.

(3) Further, the operating handle 5, which is a resin molding, slides against the tip of the handle lock lever 9 made of metal, so that abrasion dust may be collected in the recess groove in the operating handle 5 in long usage. This dust may adhere to the movable portion of the opening and closing mechanism section 3 to hinder its smooth operation, or may adhere to a surface of the main circuit contacts to hinder electrical conduction.

The present invention has been made in view of the above points, and it is an object of the invention to provide a circuit breaker with an interlock mechanism that solves the above problems to enable the contact welding induced by the abnormal state to be identified by using a simple assembly structure and to enable the circuit breaker to be recovered from the contact welding by operating the handle and without disassembling the breaker, provided that the contact welding is not severe.

Further objects and advantages of the invention will be apparent from the following description of the invention.

SUMMARY OF THE INVENTION

To solve the above problem, the present invention provides a circuit breaker, in which an opening and closing mechanism linked with a rotary operating handle via a gear mechanism section comprises an opening and closing lever that rotationally moves in a vertical direction so as to follow an ON operation and an OFF operation of the handle and an operation of an overcurrent tripping device. The rotational movement of the opening and closing lever opens or closes main circuit contacts disposed below the lever, and the circuit breaker indicates a state of the main circuit contacts using a position of the operating handle. The circuit breaker includes a handle lock lever for interlocking a tip of the opening and closing lever projecting to the side from the opening and closing mechanism section with a driving gear of the gear mechanism section that is located above the opening and closing lever and is directly coupled to the operating handle, so that when the main circuit contacts are opened while being welded, the operating handle is restrained to the vicinity of the ON position to restrict the movement thereof to a contact-open indicating position.

Specifically, this circuit breaker is constructed as follows:

(1) In the construction previously described, the handle lock lever is a rod that can be moved in the vertical direction by pressing a lower end thereof against the tip of the opening and closing lever and impelling the lower end from above using a spring, and the rod has a stopper section that is provided at an upper end thereof and engages, at an elevated position of the lock lever, a stage portion formed at a peripheral edge of the driving gear to restrain the operating handle to the vicinity of the ON position.

(2) In the above structure (1), the stopper section of the handle lock lever projects from the upper end of the rod toward a movement path of the driving gear, and has a stopper surface that is located opposite to the stage portion of the driving gear and is formed as an upward-inclined surface.

With the above construction, if the main circuit contacts are normal (contact welding is not occurring), the handle lock lever is prevented from interfering with the operating handle. On the other hand, when the opening operation is performed after the contact welding occurs, the handle lock lever restrains the operating handle to the vicinity of the ON position to restrict it from returning to the OFF or TRIP position. Thus, the indicating position of the operating handle allows an operator to identify the contact welding induced by the abnormal state.

In connection with the assembled structure, the handle lock lever is composed of an independent part separated from the opening and closing mechanism section, and is arranged so that the upper and lower ends of the lock lever are located opposite to the driving gear coupled to the operating handle and the tip of the opening and closing lever, respectively, to interconnect the driving gear with the opening and closing lever. This construction avoids complicated structure of the opening and closing mechanism section to allow the circuit breaker to be assembled easily. Further, the lock lever does not abut directly against the operating handle, which is a resin molding, thereby preventing abrasion dust and the resulting operational problems with the opening and closing mechanism section.

Furthermore, the upward-inclined surface is formed in the stopper section of the handle lock lever opposite to the stage portion of the driving gear. Consequently, if the contact welding occurs to cause the handle lock lever to restrain the operating handle to the vicinity of the ON position as previously described, provided that the contact welding is not severe, force can be applied to the operating handle to rotate it to the OFF position to thereby push the tip of the opening and closing lever via the lock lever using a downward vector component of force applied to the inclined surface of the stopper section. As a result, the movable contact shoe of the main circuit contact is forcibly separated from the fixed contact shoe to open the contacts.

BRIEF DESCRIPTION OF THE DRAWINGS

FIG. 1(*b*) is an enlarged top view of an essential part of FIG. 1(*a*);

FIG. 3(*b*) is a plan view of FIG. 3(*a*);

FIG. 4(*b*) is a detailed view showing the structure of an opening and closing mechanism; FIG. 4(*c*) is an exploded perspective view of the appearance of an operating handle and its peripheral mechanism; and FIG. 4(*d*) is a detailed view showing the structure of a contact-breaking section shown in FIG. 4(*a*); FIGS. 5(*b*), 5(*c*) and 5(*d*) are views representing operational states corresponding to OFF and ON states of main circuit contacts and occurrence of contact welding, respectively.

DETAILED DESCRIPTION OF PREFERRED EMBODIMENT

Figure 1A:
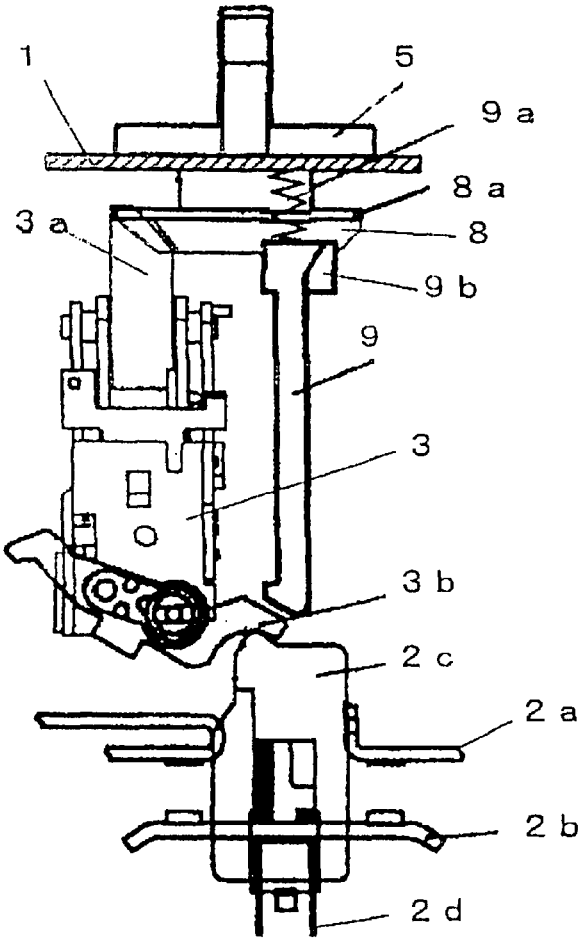
FIG. 1(*a*) is an explanatory side view showing a construction of an essential part of a circuit breaker according to an embodiment of the present invention.

An embodiment of the present invention will be described based on the drawings shown in FIGS. 1(*a*) to 3(*b*). In the FIGS. for the embodiment, members corresponding to FIGS. 5(*a*)–5(*d*) are denoted by the same reference numerals, and a detailed description thereof is omitted.

Figure 1B:
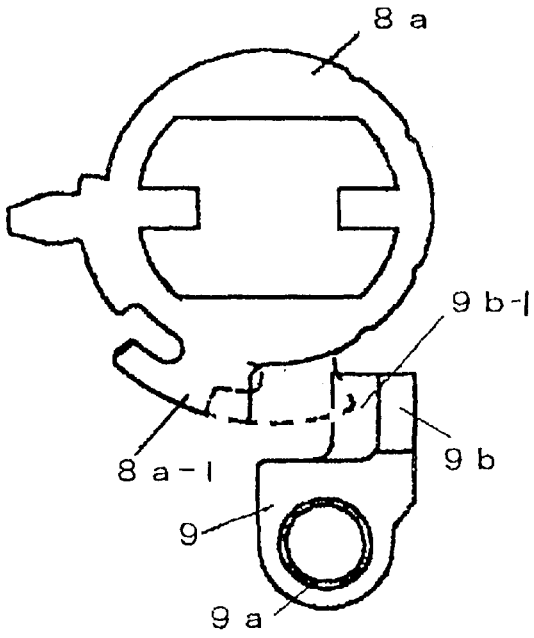

As shown in FIGS. 1(*a*) and 1(*b*), in the illustrated embodiment, the handle lock lever 9 is separated from the opening and closing mechanism section 3, and is arranged so as to interconnect the tip of the opening and closing lever 3*b* projecting to the side from the opening and closing mechanism section 3 with a clutch gear 8*a* of the driving gear 8 located above the opening and closing lever and directly coupled to an operating handle 5, so that the handle lock lever 9 is supported and guided so as to move in the vertical direction. In the illustrated circuit breaker, the metallic clutch gear 8*a*, directly coupled to the shaft of the operating handle 5, is combined with the driving gear 8 of the gear mechanism for coupling the operating handle 5 and the toggle gear 3*a* of the opening and closing mechanism section 3 together for transmission, so that in the initial stage, when the operating handle 5 is rotated from the OFF to the ON position, the clutch gear 8*a* runs idly, and during the idle running, the quick-turn-on contacts of an undervoltage tripping device (outer accessory) are turned on. Although not illustrated, the circuit breaker case 1 has a vertical clearance groove formed when the opening and closing mechanism 3 is integrated into the case, with the clearance groove corresponding to the tip of the opening and closing lever 3*b*. The handle lock lever 9 is supported and guided by using this clearance groove.

In this case, the handle lock lever 9 is a rod formed of a resin molding, and a return spring (compression coil spring) 9*a* is interposed between the upper end of the handle lock lever 9 and the case cover to urge the handle lock lever 9 so that the lower end thereof is pressed against the top surface of the tip of opening and closing lever 3*b*. Further, an arm-shaped stopper section 9*b* is integrally molded at the upper end of the lock lever 9 so as to protrude therefrom and extend into a movement path of a stage portion 8*a*-1 formed on a periphery of the clutch gear 8*a*. The stopper section 9*b* has an upward-inclined surface 9*b*-1 formed opposite to the stage portion of the clutch gear 8*a*.

Figure 2A:
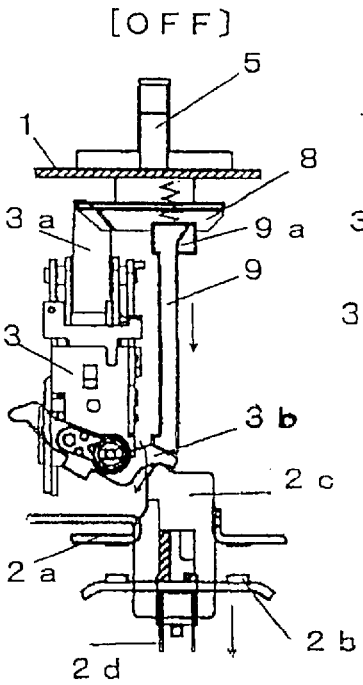
FIGS. 2(*a*), 2(*b*) and 2(*c*) are explanatory views showing operational states corresponding to OFF and ON positions of main circuit contacts and occurrence of contact welding, respectively.
Figure 2B:
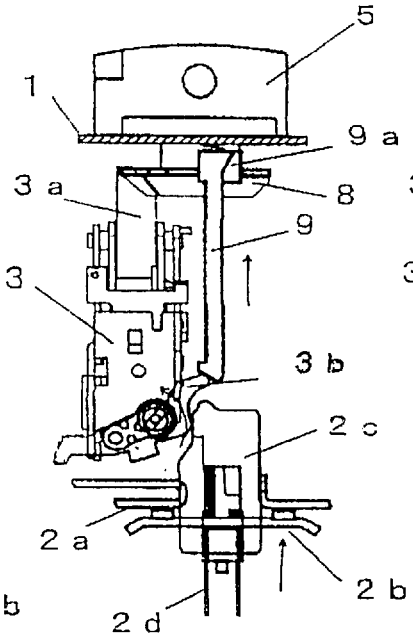
Figure 2C:
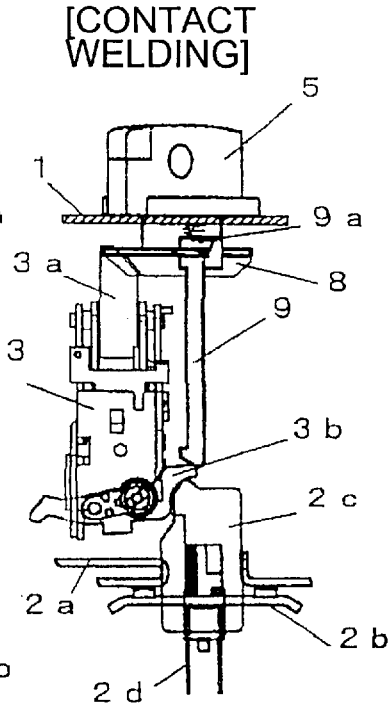

Next, an operation of the handle lock lever 9 will be described with reference to FIGS. 2(*a*) to 2(*c*). FIG. 2(*b*) to FIG. 2(*c*) correspond to FIG. 5(*a*) to FIG. 5(*d*), which represent operational states corresponding to the ON and OFF positions and the occurrence of the contact welding. When the operating handle 5 is rotated to the OFF position, as shown in FIG. 2(*a*), the opening and closing lever 3*b* rotates clockwise to open the main circuit contact. Further, the movement of the opening and closing lever 3*b* causes the return spring 9*a* to push and lower the handle lock lever 9, thereby causing the stopper section 9*b* at the upper end of the handle lock lever 9 to retreat to below the clutch gear 8*a*. On the other hand, when the operating handle 5 is rotated from the OFF to the ON position, the opening and closing lever 3*b* rotates counterclockwise to close the main circuit contact, while thrusting the handle lock lever 9 upward, as shown in FIG. 2(*b*). In this state, the stopper section 9*b* at the upper end of the lever projects into the movement path of the clutch gear 8*a*. In this manner, the handle lock lever 9 moves in the vertical direction so as to follow the rotational movement of the opening and closing lever 3*b*.

Accordingly, if the main circuit contacts are normal (contact welding does not occur), the handle lock lever 9 does not interfere with the handle, even if the handle 5 is operated to the ON or OFF position. Further, if the overcurrent tripping device performs a trip operation to open the main circuit contact, the handle lock lever 9 also lowers so as to follow the movement of the opening and closing lever 3*b*. Consequently, the operating handle 5 moves from the ON position to the TRIP position to indicate the trip state without being blocked by the lock lever 9.

On the other hand, if the contact welding occurs during the trip operation of the circuit breaker, the opening and closing lever 3*b* is restrained by the movable contact shoe holder 2*c* and remains stopped at basically the same position as that prior to the trip operation, as shown in FIG. 2(*c*). Consequently, the handle lock lever 9 remains at its elevated position, where the stopper section 9*b* at the upper end thereof hinders the movement of the clutch gear 8*a* and thus restricts the operating handle 5 from returning from this position to the OFF position. Thus, the operating handle 5 is stopped after rotating slightly from the ON position (a position closer to the ON position than to the TRIP position), and does not indicate the TRIP position. This allows the operator to identify the contact welding induced by the abnormal state.

Figure 3A:
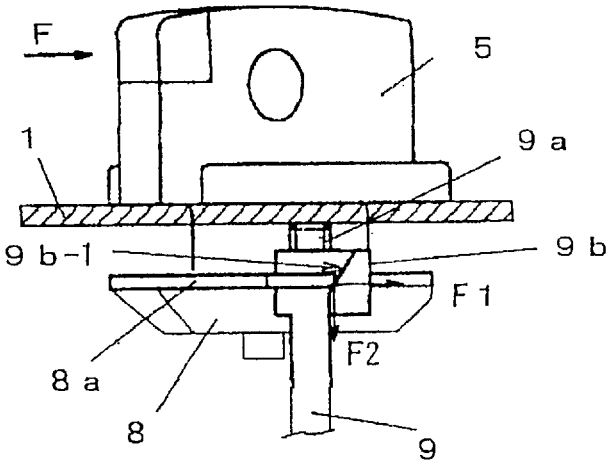
FIG. 3(*a*) is a side view illustrating a recovery operation for the contact welding with the construction shown in FIG. 1.
Figure 3B:
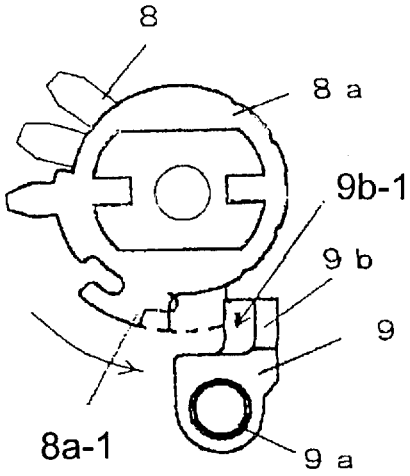
Figure 4A:
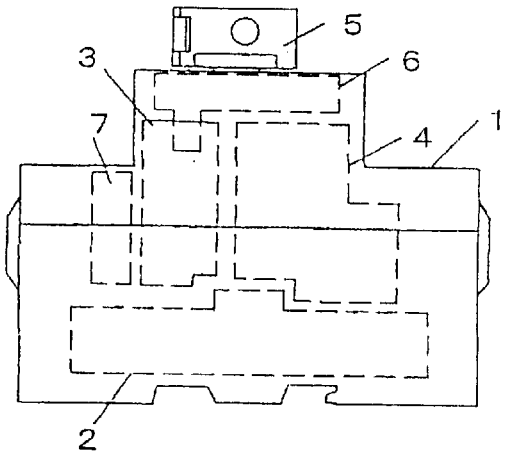
Fig. 4(a) Prior Art
FIG. 4(*a*) is a schematic view showing the entire construction of a conventional circuit breaker.
Figure 4B:
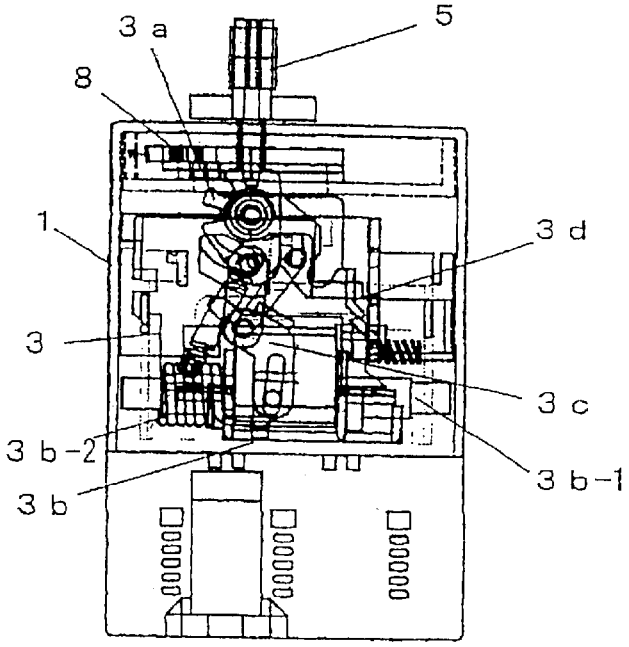
Fig. 4(b) Prior Art
Figure 4C:
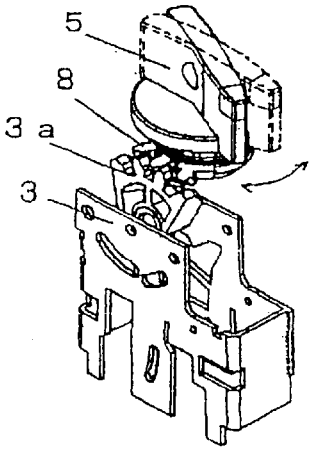
Fig. 4(c) Prior Art
Figure 4D:
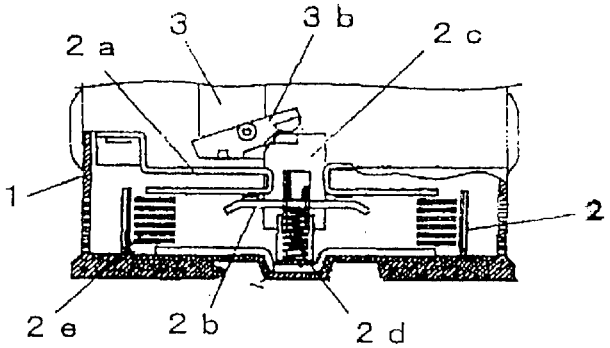
Fig. 4(d) Prior Art
Figure 5A:
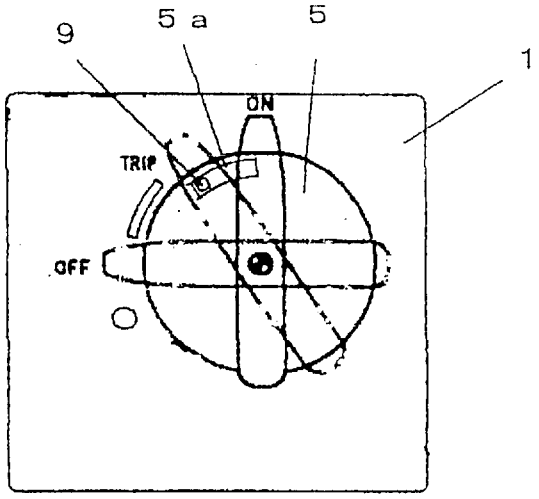
Fig. 5(a) Prior Art
FIG. 5(*a*) is a top view showing indicating positions of an operating handle of a conventional circuit breaker.
Figure 5B:
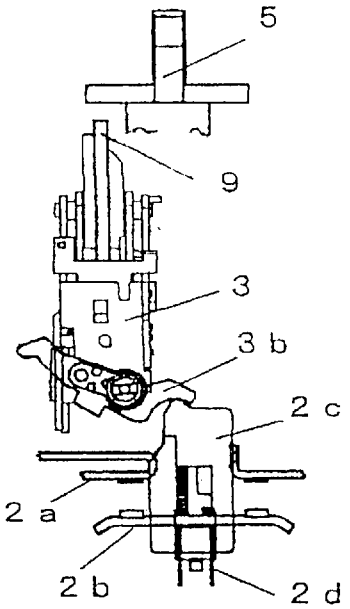
Fig. 5(b) Prior Art
Figure 5C:
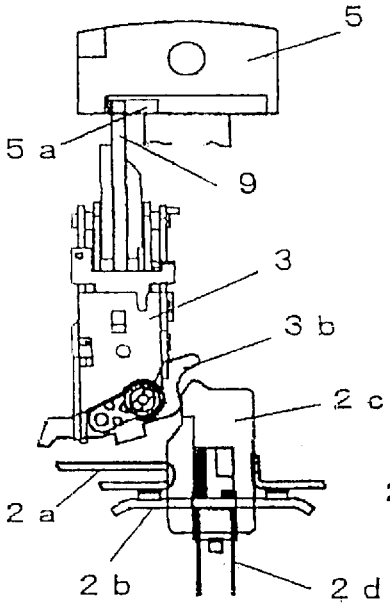
Fig. 5(c) Prior Art
Figure 5D:
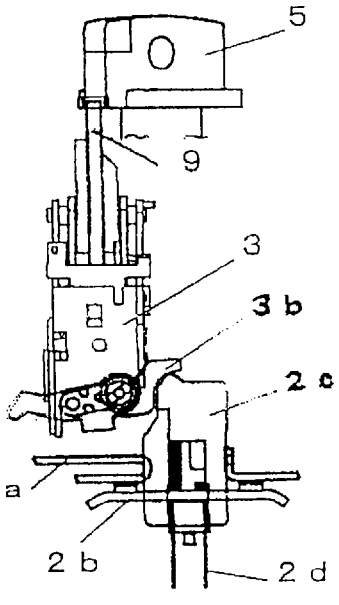
Fig. 5(d) Prior Art

Further, the upwardly inclined surface 9*b*-1 formed in the stopper section 9*b* of the handle lock lever 9 functions as follows. Namely, as described in FIG. 2(*c*), after the contact welding occurs, when the handle lock lever 9 is operated to stop the operating handle 5 in the vicinity of the ON position and manual force is applied to the operating handle 5 so as to rotate it to the OFF position, operating force F applied to the handle acts on the inclined surface 9*b*-1 via the stage portion 8*a*-1 of the clutch gear 8*a* as force F1, as shown in FIGS. 3(*a*) and (*b*). Then, force F2 acts on the opening and closing lever 3*b* via the lock lever 9 so as to push the tip of the lever downward, and the force F2 is a vertical vector component of the force F1 and corresponds to the inclination of the inclined surface 9*b*-1. Consequently, if the welding of the main circuit contacts is not severe, the movable contact shoe 2*b* is separated from the fixed contact shoe 2*a* to open the main circuit contact. That is, even if the contact welding prevents the circuit breaker from opening the contacts, if the contact welding is not severe, the breaker can be recovered from the contact welding without the need to disassemble the breaker, simply by applying force to the operating handle to rotate it to the OFF position.

As described above, according to the construction of the present invention, if the main circuit contacts are welded, the contact welding induced by errors can be identified on the basis of the position of the operating handle indicated when the opening operation is to be performed. Further, with respect to the structure of the present invention, the handle lock lever is composed of an independent part separated from the opening and closing mechanism section, and is arranged so that the upper and lower ends of the lock lever are located opposite to the gear mechanism coupled to the operating handle and the tip of the opening and closing lever integrated with the opening and closing mechanism section, respectively, to interconnect the gear mechanism with the opening and closing lever. This structure avoids complicated structure of the opening and closing mechanism section to allow the circuit breaker to be assembled easily. Further, the lock lever does not abut directly against the operating handle, which is a resin molding, thereby preventing abrasion dust and the resulting operational problems with the opening and closing mechanism section.

Furthermore, the upwardly inclined surface is formed in the stopper section of the handle lock lever opposite to the stage portion of the driving gear. Consequently, even if the main circuit contacts are welded, provided that the contact welding is not severe, force can be applied to the operating handle to rotate it to the OFF position to thereby push the tip of the opening and closing lever via the lock lever. As a result, the movable contact shoe of the main circuit contacts can be forcibly separated from the fixed contact shoe to recover the main contact circuit from the contact welding.

While the invention has been explained with reference to the specific embodiment of the invention, the explanation is illustrative and the invention is limited only by the appended claims.

What is claimed is:

1. A circuit breaker comprising:

a rotary-operating handle, a gear mechanism connected to the rotary-operating handle and having a driving gear, an opening and closing mechanism linked with the rotary-operating handle through the gear mechanism and having an opening and closing lever that rotationally moves in a vertical direction following ON and OFF operations of the rotary-operating handle, main circuit contacts situated below and actuated by the opening and closing lever, a state of the main circuit contacts being indicated by a position of the rotary-operating handle, an overcurrent tripping device connected to the opening and closing mechanism and moving the opening and closing lever in the vertical direction, and a handle lock lever for interlocking a tip of the opening and closing lever located at a side of the opening and closing mechanism between the driving gear of the gear mechanism and the opening and closing lever so that when the main circuit contacts are opened after being welded, the operating handle is restrained to a vicinity of an ON position in order to restrict a movement of the rotary-operating handle to a contact-open indicating position.

2. A circuit breaker according to claim 1, further comprising a spring situated above the handle lock lever to urge the handle lock lever downwardly, said driving gear having a stage portion at a peripheral edge thereof, said handle lock lever being a rod that can be moved in the vertical direction by pressing a lower end thereof against a top surface of the opening and closing lever and has a stopper section at an upper end thereof, and engaging, at an elevated position of the lock lever, the stage portion to restrain the operating handle to the vicinity of the ON position.

3. A circuit breaker according to claim 2, wherein said stopper section of the handle lock lever projects from an upper end of the rod toward a movement path of the driving gear, and has a stopper surface facing the stage portion of the driving gear as an upward-inclined surface.

* * * * *